US008098201B2

(12) United States Patent
Choi et al.

(10) Patent No.: US 8,098,201 B2
(45) Date of Patent: Jan. 17, 2012

(54) RADIO FREQUENCY IDENTIFICATION TAG AND RADIO FREQUENCY IDENTIFICATION TAG ANTENNA

(75) Inventors: Won Kyu Choi, Daejeon (KR); Jeong Seok Kim, Daejeon (KR); Gil Young Choi, Daejeon (KR); Hae Won Son, Daejeon (KR); Cheol Sig Pyo, Daejeon (KR); Jong-Suk Chae, Daejeon (KR)

(73) Assignees: Electronics & Telecommunications Research Institute, Daejeon (KR); Industrial Cooperation Foundation of Chonbuk National University, Jeonju-si (KR)

( * ) Notice: Subject to any disclaimer, the term of this patent is extended or adjusted under 35 U.S.C. 154(b) by 576 days.

(21) Appl. No.: 12/135,851

(22) Filed: Jun. 9, 2008

(65) Prior Publication Data

US 2009/0140928 A1 Jun. 4, 2009

(30) Foreign Application Priority Data

Nov. 29, 2007 (KR) ..... 10-2007-0122892
Feb. 21, 2008 (KR) ..... 10-2008-0015993

(51) Int. Cl.
*H01Q 1/38* (2006.01)

(52) U.S. Cl. ..... 343/700 MS; 343/741; 343/866; 340/572.7

(58) Field of Classification Search ..... 343/700 MS, 343/866, 795, 741; 340/572.7
See application file for complete search history.

(56) References Cited

U.S. PATENT DOCUMENTS

| | | | | |
|---|---|---|---|---|
| 6,023,080 | A * | 2/2000 | Kojima | 257/275 |
| 6,097,347 | A | 8/2000 | Duan et al. | |
| 6,172,497 | B1 * | 1/2001 | Okumichi | 324/754.06 |
| 7,057,574 | B2 * | 6/2006 | Shamir et al. | 343/866 |
| 7,405,664 | B2 | 7/2008 | Sakama et al. | |
| 7,522,113 | B2 * | 4/2009 | Andrenko et al. | 343/726 |
| 7,598,873 | B2 * | 10/2009 | Yamagajo et al. | 340/572.7 |
| 2006/0032926 | A1 * | 2/2006 | Baba et al. | 235/492 |
| 2006/0220869 | A1 * | 10/2006 | Kodukula et al. | 340/572.7 |
| 2007/0080867 | A1 * | 4/2007 | Son et al. | 343/700 MS |
| 2007/0097003 | A1 * | 5/2007 | Sasaki et al. | 343/742 |
| 2007/0229276 | A1 * | 10/2007 | Yamagajo et al. | 340/572.7 |

FOREIGN PATENT DOCUMENTS

| | | |
|---|---|---|
| JP | 2003-187211 | 7/2003 |
| JP | 2006-025390 | 1/2006 |
| KR | 10-0688093 | 2/2007 |

OTHER PUBLICATIONS

"Planar inverted-F antenna for radio frequency identification" in IEE Electronics Letters online Jul. 8, 2004, vol. 40, No. 14.

* cited by examiner

*Primary Examiner* — Dieu H Duong
(74) *Attorney, Agent, or Firm* — Kile Park Goekjian Reed & McManus PLLC

(57) ABSTRACT

An RFID tag includes an antenna and a chip, and the antenna includes a first polygonal dielectric material, first and second microstrip lines partially formed in the first dielectric material, a second polygonal dielectric material stacked on the first dielectric material, and a third microstrip line partially formed in the second dielectric material. According to the present invention, the RFID tag can efficiently receive electromagnetic waves to thereby maximize a readable range.

13 Claims, 4 Drawing Sheets

RADIO FREQUENCY IDENTIFICATION TAG AND RADIO FREQUENCY IDENTIFICATION TAG ANTENNA

CROSS-REFERENCE TO RELATED APPLICATION

This application claims priority to and the benefit of Korean Patent Application Nos. 10-2007-0122892 and 10-2008-0015993 filed in the Korean Intellectual Property Office on Nov. 29, 2007 and Feb. 21, 2008, the entire contents of which are incorporated herein by reference.

BACKGROUND OF THE INVENTION (a) Field of the Invention

The present invention relates to a radio frequency identification tag and a radio frequency identification tag antenna. Particularly, it relates to a radio frequency identification tag and a radio frequency identification tag antenna using a stacked structure.

The present invention was supported by the IT R&D program of MIC/IITA [2006-S-023-02, Development of Advanced RFID System Technology].

(b) Description of the Related Art

A radio frequency identification (RFID) tag is used in various fields such as distribution and material handling industries, together with an RFID reader. In general, an RFID system includes an RFID tag and an RFID reader.

When an object to which the RFID tag is attached accesses a read zone of the RFID reader, the RFID reader transmits an interrogation signal to the RFID tag by modulating a continuous electromagnetic wave having a specific frequency. Then, the RFID tag transmits back the electromagnetic wave transmitted from the RFID reader after performing back-scattering modulation in order to transmit information stored in the RFID tag's internal memory. The back-scattering modulation is a method for transmitting tag information by modulating the amplitude and/or the phase of a scattered electromagnetic wave when the RFID tag transmits the electromagnetic wave that is initially transmitted from the RFID reader back to the RFID reader by scattering the electromagnetic wave.

A passive RFID tag rectifies the electromagnetic wave transmitted from the RFID reader and uses the rectified electromagnetic wave as its own power source to acquire operation power, and the intensity of the electromagnetic wave transmitted from the RFID reader should be larger than a specific threshold value for normal operation of the passive RFID tag.

Since the intensity of the signal is decreased when a distance between the RFID reader and the RFID tag is increased, the transmission power of the RFID reader should be increased so as to increase a range within which the RFID reader can read the RFID tag in the RFID system. Hereinafter, the range between the RFID reader and the RFID tag is referred to as a readable range. However, it is not possible to unconditionally raise the level of the transmission power because the transmission power of the RFID reader is limited by local regulations of each country, and therefore, the RFID tag should efficiently receive the electromagnetic wave transmitted from the RFID reader so as to maximize the readable range with the limited transmission power.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a radio frequency identification (RFID) tag having advantages of efficiently receiving electromagnetic waves transmitted from an RFID reader so as to maximize a readable range of the RFID reader.

In one aspect of the present invention, an RFID tag includes an antenna that receives an interrogation signal corresponding to a radio frequency (RF) signal and a chip that generates a response signal corresponding to the interrogation signal, and the antenna includes a first polygonal dielectric material, a first microstrip line, a second microstrip line, a second polygonal dielectric material, and a third microstrip line. The first polygonal dielectric material has a first plane corresponding to a ground plane and a second plane that does not contact the first plane. The first microstrip line is formed in a part of the second plane, and has two lateral ends. The second microstrip line is formed in a part of the second plane, and has two lateral ends. The second polygonal dielectric material has a third plane that partially contacts the second plane and a fourth plane that does not contact the third plane, and is stacked on the first dielectric material. The third microstrip line is formed in the fourth plane, and has two lateral ends.

The antenna further includes a first feed terminal connected to one of the two lateral ends of the first microstrip line and a second feed terminal connected to one of the two lateral ends of the second microstrip line, and the chip is partially formed in the second plane to contact the third plane, electrically connected to the first microstrip line through the first feed terminal, and electrically connected to the second microstrip line through the second feed terminal.

In addition, impedance of the antenna and impedance of the chip respectively include a resistance component and a reactance component, a value of the resistance component of the impedance of the antenna and a value of the resistance component of the impedance of the chip are the same in the size and have the same sign, and the value of the resistance component of the impedance of the antenna and the value of the resistance component of the impedance of the chip are the same in size but opposite in sign.

The impedance of the antenna corresponds to the length of the first microstrip line, the length of the second microstrip line, and the length of the third microstrip line.

The resistance component of the impedance of the antenna corresponds to the width of an end connected to the first feed terminal among the two ends of the first microstrip line and the width of an end connected to the second feed terminal among the two lateral ends of the second microstrip line, and the reactance component of the impedance of the antenna corresponds to the distance of the two lateral ends of the first microstrip lines, the distance of the two lateral ends of the second microstrip lines, and the distance of the two lateral ends of the third microstrip lines.

In another aspect of the present invention, an RFID tag antenna includes a first polygonal dielectric material, a first microstrip line, a second microstrip line, a second polygonal material, and a third microstrip line. The first polygonal dielectric material has a first plane corresponding to a ground plane and a second plane that does not contact the first plane. The first microstrip line is formed in a part of the second plane, and has two lateral ends. The second microstrip line is formed in a part of the second plane, and has two lateral ends. The second polygonal dielectric material has a third plane and a fourth plane, and is stacked on the first dielectric material. The third plane partially contacts the second plane, the first microstrip line, and the second microstrip line. The third microstrip line is partially or entirely formed in the fourth plane. One of the two lateral ends of the first microstrip line and one of the two lateral ends of the second microstrip line face each other.

One of the first and second microstrip lines has two lateral ends that are the same in width.

One of the first and second microstrip lines has two lateral ends that are different from each other in width.

The first microstrip line and the second microstrip line respectively have lateral ends that are different from each other in width, and a shorter one of the two lateral ends of the first microstrip line and a shorter one of the two lateral ends of the second microstrip line face each other.

The third microstrip line has a curved circumference.

The third microstrip line has a polygonal-shaped circumference.

The microstrip line has a ring shape.

In addition, the RFID tag antenna includes a first shorting plate and a second shorting plate. The first shorting plate is formed in a fifth plane that connects the first and second planes, and connects the first microstrip line and the ground plane so as to disconnect the microstrip line from the ground plane. The second shorting plate is formed in a sixth plane that connects the first and second planes, and connects the second microstrip line and the ground line so as to disconnect the second microstrip line from the ground plane.

According to the present invention, an RFID tag can efficiently receive electromagnetic waves from an RFID reader without a loss through impedance-matching of an RFID tag antenna with an RFID tag chip to thereby maximize a readable range of the RFID tag.

DETAILED DESCRIPTION OF THE EMBODIMENTS

Figure 1:
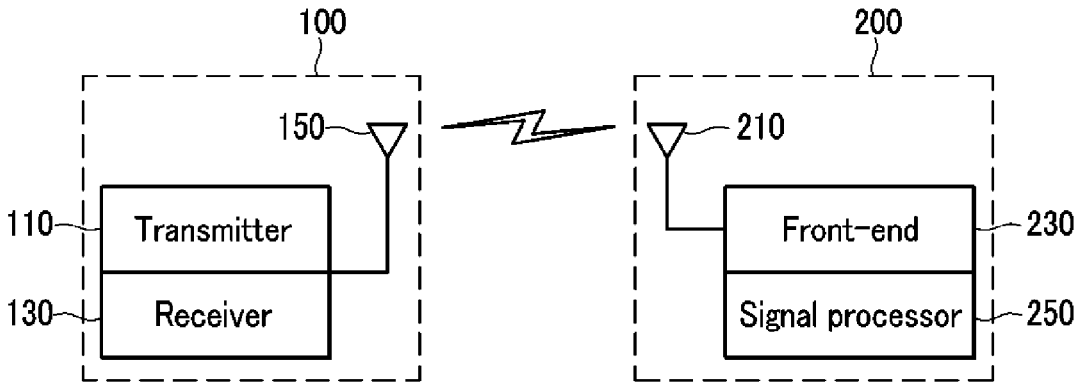
FIG. 1 is a configuration of a radio frequency identification (RFID) system according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims which follow, unless explicitly described to the contrary, the word "comprising" and variations such as "comprises" will be understood to imply the inclusion of stated elements but not the exclusion of any other elements. Also, the terms of a unit, a device, and a module in the present specification represent a unit for processing a predetermined function or operation, which can be realized by hardware, software, or a combination of hardware and software.

A radio frequency identification tag according to an exemplary embodiment of the present invention will be described with reference to the drawings.

A radio frequency identification (RFID) system according to the exemplary embodiment of the present invention will now be described with reference to FIG. 1.

FIG. 1 shows a configuration of the RFID system according to the exemplary embodiment of the present invention.

As shown in FIG. 1, the RFID system includes an RFID reader 100 and an RFID tag 200. The RFID reader 100 transmits an interrogation signal to the RFID tag 200 after modulating a continuous electromagnetic wave having a specific frequency, and receives a response signal that corresponds to the transmitted interrogation signal. The RFID tag 200 receives the interrogation signal transmitted from the RFID reader 100 and transmits a response signal after performing back-scattering modulation on the received signal. The interrogation signal and the response signal respectively correspond to a radio frequency (RF) signal.

The RFID reader 100 includes a transmitter 110, a receiver 130, and a reader antenna 150. The transmitter 110 transmits the interrogation signal to the RFID tag 200 through the reader antenna 150, and the receiver 130 receives the response signal transmitted from the RFID tag 200 through the reader antenna 150. In this instance, the reader antenna 150 is electrically connected to the transmitter 110 and the receiver 130.

The RFID tag 200 includes a tag antenna 210, a front-end 230, and a signal processor 250. The tag antenna 210 receives the interrogation signal transmitted from the RFID reader 100 and delivers the received interrogation signal to the front-end 230, and the front-end 230 converts the signal delivered by the tag antenna 210 into a direct current (DC) voltage so as to supply operation power to the signal processor 250 and extracts a baseband signal from the RF signal (i.e., interrogation signal). The signal processor 250 receives the baseband signal from the front-end 230, performs back-scattering modulation on the input signal, and transmits a response signal that corresponds to the interrogation signal to the RFID reader 100.

In order to increase the readable range of the RFID system, the tag antenna 210 should efficiently deliver the received signal to the front-end 230 without a loss. Therefore, impedance of the tag antenna 210 should conjugate-matched with impedance of the front-end 230.

An equivalent circuit of the tag antenna and the front-end according to the exemplary embodiment of the present invention will now be described with reference to FIG. 2.

Figure 2:
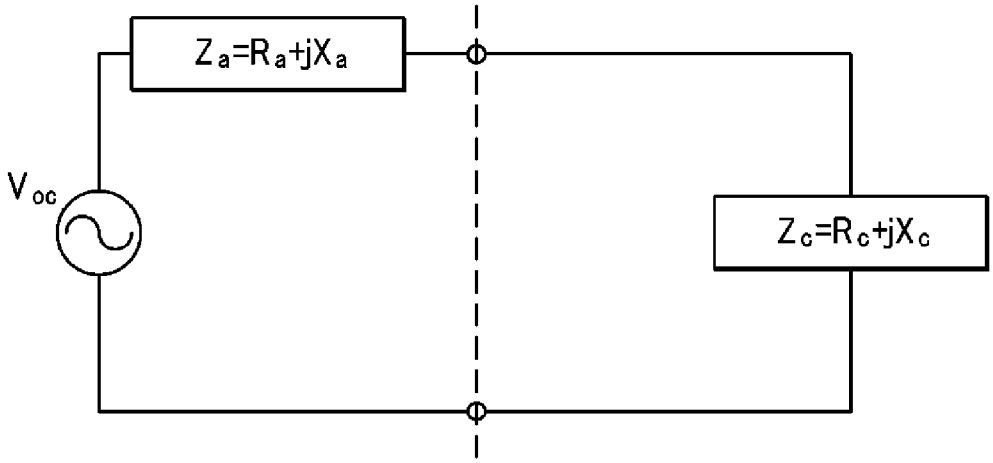
FIG. 2 is an equivalent circuit diagram of a tag antenna and a front-end according to the exemplary embodiment of the present invention.

FIG. 2 shows an equivalent circuit of the tag antenna and the front-end according to the exemplary embodiment of the present invention.

As shown in FIG. 2, the entire equivalent circuit includes a voltage source $V_{oc}$, impedance $Z_a$ of the tag antenna, and impedance $Z_c$ of the front-end. Herein, the voltage source $V_{oc}$ and the impedance $Z_a$ of the tag antenna form an equivalent circuit of the tag antenna 210, and the impedance $Z_c$ of the front-end forms an equivalent circuit of the front-end 230.

The impedance $Z_a$ of the tag antenna has a resistance component $R_a$ and a reactance component $X_a$, and the impedance $Z_c$ of the front-end has a resistance component $R_c$ and a reactance component $X_c$.

The tag antenna 210 can transmit the maximum transmission power to the front-end 230 when the impedance $Z_a$ of the tag antenna is conjugate-matched with the impedance $Z_c$ of the front-end. When conjugate-matching is performed on two complex impedances, absolute values of the two impedances become the same and the signs of the phase of the two impedances become opposite to each other. The impedance $Z_a$ of the tag antenna is conjugate-matched with the impedance $Z_c$ of the front-end, and can be conjugate-mated as shown in Equation 1.

$$R_a=R_c$$

$$X_a=-X_c \qquad \text{[Equation 1]}$$

When the RFID tag 200 is a passive RFID tag, the front-end 230 includes a diode rectifier circuit and a detector circuit, and does not include an additional matching circuit. Therefore, the impedance $Z_c$ of the front-end has a complex impedance value that is different from a typical impedance value (i.e., 50Ω), and has a small resistance component $R_c$ and a large capacitive reactance component $X_c$ within an ultra high frequency (UHF) band due to characteristics of the rectifier and detector circuits.

For conjugate-matching with the above-stated impedance $Z_c$ of the front-end, the impedance $Z_a$ of the tag antenna should have a small resistance component $R_a$ and a large inductive reactance component $X_a$.

An RFID tag according to another exemplary embodiment of the present invention will now be described in detail with reference to FIG. 3 and FIG. 4.

Figure 3:
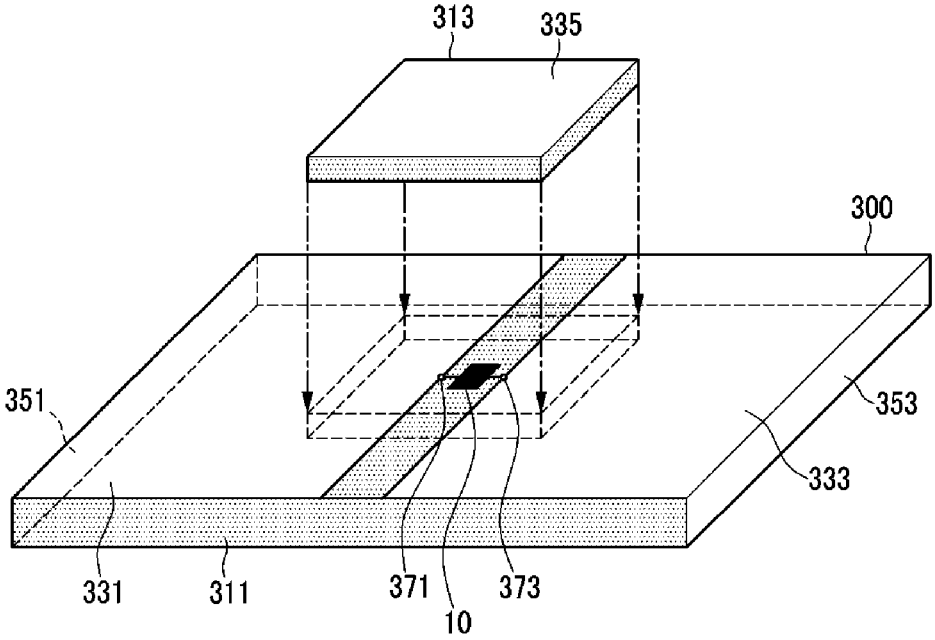
FIG. 3 is a configuration of an RFID tag according to one exemplary embodiment of the present invention.

FIG. 3 shows a configuration of an RFID tag according to another exemplary embodiment of the present invention.

As shown in FIG. 3, the RFID tag includes an RFID tag chip 10 and a tag antenna 300. The RFID tag chip 10 includes a front-end and a signal processor.

The tag antenna 300 includes two dielectric material substrates 311 and 313 (i.e., first dielectric material substrate 311 and second dielectric material substrate 313), three microstrip lines 331, 333, and 335 (i.e., first microstrip line 331, second microstrip line 333, and third microstrip line 335), two shorting plates 351 and 353 (i.e., first shorting plate 351 and second shorting plate 353), and two feed terminals 371 and 373 (i.e., first feed terminal 371 and second feed terminal 373).

The first microstrip line 331, the second microstrip line 333, the first feed terminal 371, the second feed terminal 373, and the RFID tag chip 10 are formed on an upper plane of the first dielectric material substrate 311, and the first and second shorting plates 351 and 353 are formed in two sides among four sides of the first dielectric material substrate 311.

The third microstrip line 335 is formed on an upper plane of the second dielectric material substrate 313, and a bottom plane of the second dielectric material substrate 313 partially contacts a part of the upper plane of the first dielectric material substrate 311 such that the tag antenna 300 has a stacked structure of the first dielectric material substrate 311 and the second dielectric material substrate 313.

The first dielectric material substrate 311 has a cuboid shape, and a bottom plane thereof corresponds to a ground plane.

The first microstrip line 331 has a rectangle shape, and is formed in a part of the upper plane of the first dielectric material substrate 311 (i.e., the left area of the upper plane of the first dielectric material substrate 311 in the drawing) so as to contact the left side of the first dielectric material substrate 311. In this instance, one end of the first microstrip line 331 is disconnected by the first shorting plate 351 formed in the left side of the first dielectric material substrate 311, and the other end is opened.

The second microstrip line 333 has a rectangle shape, and is formed in a part of the upper plane of the first dielectric material substrate 311 (i.e., the right area of the upper plane of the first dielectric material substrate 311 in the drawing) so as contact the right side of the first dielectric material substrate 311. In this instance, one end of the second microstrip line 333 is disconnected by the second shorting plate 353 formed in the right side of the first dielectric material substrate 311, and the other end is opened.

The opened end of the first microstrip line 331 and the opened end of the second microstrip line 333 face each other at a center portion of the first dielectric material substrate 311.

The first shorting plate 351 has a rectangle shape, and is formed in one side among four sides of the first dielectric material substrate 311 (i.e., the left side of the first dielectric material substrate 311 in the drawing) and connects the ground plane that corresponds to the bottom plane of the first dielectric material substrate 311 and the first microstrip line 331 so as to disconnect the first microstrip line 331 from the ground plane.

The second shorting plate 353 has a rectangle shape, and is formed in one side among the four sides of the first dielectric material substrate 311 (i.e., the right side of the first dielectric material substrate 311 in the drawing) and connects the ground plane that corresponds to the bottom plane of the first dielectric material substrate 311 and the second microstrip line 333 so as to disconnect the second microstrip line 333 from the ground plane.

The first feed terminal 371 is formed in a part of the upper plane of the first dielectric material substrate 311 and contacts the opened end of the first microstrip line 331 such that the first feed terminal 371 and the first microstrip line 331 are electrically connected.

The second feed terminal 373 is formed in a part of the upper plane of the first dielectric material substrate 311 and contacts the opened end of the second microstrip line 333 such that the second feed terminal 373 and the second microstrip line 333 are electrically connected.

The first feed terminal 371 and the second feed terminal 373 are formed between the opened ends of the first and second microstrip lines 331 and 333 facing each other, and the RFID tag chip 10 is formed between the first and second feed terminals 371 and 373.

The second dielectric material substrate 313 has a cuboid shape, and a bottom plane thereof partially contacts the upper plane of the first dielectric material substrate 311, the first microstrip line 331, the second microstrip line 333, the first feed terminal 371, the second feed terminal 373, and the RFID tag chip 10.

The third microstrip line 335 has a rectangle shape and is formed in an upper plane of the second dielectric material substrate 313, and lateral ends of the third microstrip line 335 are opened. The third microstrip line 335 does not include a ground plane, and the first microstrip line 331 and the second microstrip line 333 serve as the ground plane of the third microstrip line 335 instead.

The third microstrip line 335 serves as an open stub that is coupled in parallel with the first feed terminal 371 and the second feed terminal 373, and adds a capacitive reactance, together with the first and second feed terminals 371 and 373. When the size of the third microstrip line 335 is smaller than a wavelength that corresponds to an operation frequency of the tag antenna 300, the effect of the third microstrip line 335 is the same as that of a flat capacitor that is coupled in parallel with the feed terminals. Accordingly, impedance matching of the tag antenna 300 and the front-end included in the RFID tag chip 10 can be simply performed through the third microstrip line 335.

Figure 4:
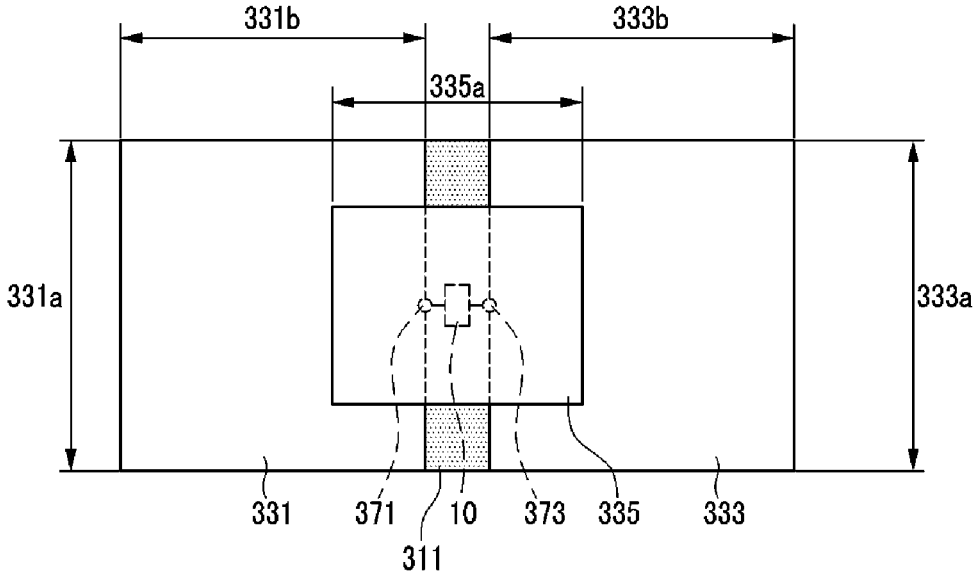
FIG. 4 is a top plan view of the RFID tag according to the exemplary embodiment of the present invention.

FIG. 4 is a top plan view of the RFID tag according to the exemplary embodiment of the present invention.

As shown in FIG. 4, the first microstrip line 331, the second microstrip line 333, and the third microstrip line 335 of the tag antenna 300 respectively have a width and a length.

The resistance component $R_a$ of the impedance $Z_a$ of the tag antenna 300 is determined by the width 331*a* of the first microstrip line 331, the width 333*a* of the second microstrip line 333, a dielectric loss rate of the first dielectric material substrate 311, and a dielectric loss rate of the second dielectric material substrate 313, and the reactance component $X_a$ is determined by the length 331*b* of the first microstrip line 331 and characteristic impedance, the length 333*b* of the second microstrip line 333 and characteristic impedance, and the length 335*a* of the third microstrip line 335 and characteristic impedance.

In this instance, radiation resistance of the tag antenna 300 is highly influenced by the width of the respective opened ends of the first and second microstrip lines 331 and 333, and therefore the resistance component $R_a$ of the impedance $Z_a$ of the tag antenna 300 is determined by the width 331*a* of the first microstrip line 331 and the width 333*a* of the second microstrip line 333. That is, the resistance component $R_a$ of the impedance $Z_a$ of the tag antenna 300 increases as the width 331*a* of the first microstrip line 331 and the width 333*a* of the second microstrip line 333 increase. Further, the resistance component $R_a$ of the impedance $Z_a$ of the tag antenna 300 increases as the dielectric loss rates of the first and second dielectric material substrate 311 and 313 increase.

In addition, the reactance component $X_a$ of the impedance $Z_a$ of the tag antenna 300 is determined by the length 331*b* of the first microstrip line 331 and characteristic impedance and the length 333*b* of the second microstrip line 333 and characteristic impedance. In other words, the reactance component $X_a$ of the impedance $Z_a$ of the tag antenna 300 increases as each characteristic impedance of the first microstrip line 331 and the second microstrip line 333 increase and as each length of the first microstrip line 331 and the second microstrip line 333 increase.

The length of the microstrip line 331 and the length of the second microstrip line 333 can be changed for conjugate-matching of the impedance of the tag antenna 300 and the impedance $Z_c$ of the front-end included in the RFID tag chip 10.

However, when the length of the first microstrip line 331 and the second microstrip line 333 is limited for down-sizing the tag antenna 300, the reactance component $X_a$ may not be large enough for the conjugate-matching with the impedance $Z_c$ of the front-end.

In this instance, a slot may be formed in the microstrip line so as to acquire a desired reactance component by using a short microstrip line, but unexpected radiation may occur in the slot, thereby causing deterioration of radiation efficiency of the tag antenna 300.

According to the exemplary embodiment of the present invention, a capacitive reactance is added in parallel to the first and second feed terminals by using the third microstrip line 335 to thereby acquire a desired reactance component $X_a$ despite the size limitation. In this instance, the reactance component $X_a$ of the tag antenna 300 increases as the length 335*a* of the third microstrip line 335 increases within a range that does not exceed 0.5 times a wavelength that corresponds to the operation frequency of the tag antenna 300 increasing and the characteristic impedance of the third microstrip line 335 decreasing.

In the drawing, the length 331*b* of the first microstrip line 331 and the length 333*b* of the second microstrip line 333 are the same, but they may be designed to be different from each other as necessary.

In the drawing, the width 331*a* of the first microstrip line 331 and the width 333*a* of the second microstrip line 333 are the same, but they may be designed to be different from each other as necessary.

An RFID tag according to another exemplary embodiment of the present invention will now be described with reference to FIG. 5.

Figure 5:
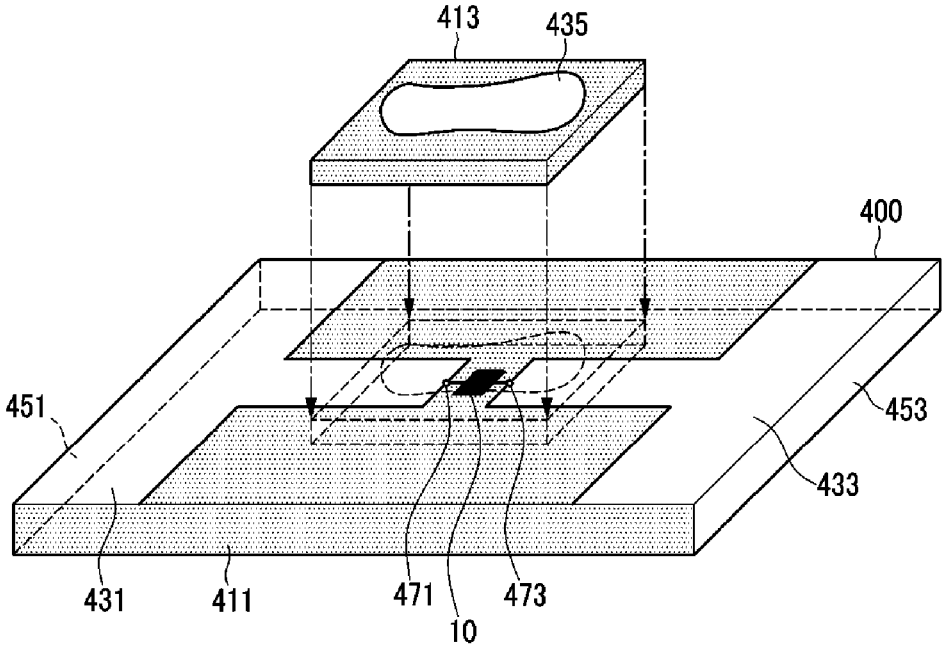
FIG. 5 is a configuration of an RFID tag according to another exemplary embodiment of the present invention.

FIG. 5 shows an RFID tag according to another exemplary embodiment of the present invention.

As shown in FIG. 5, the RFID tag according to the exemplary embodiment of the present invention includes an RFID tag chip 10 and a tag antenna 400.

The tag antenna 400 includes two dielectric material substrates 411 and 413 (i.e., first dielectric material substrate 411 and second dielectric material substrate 413), three microstrip lines 431, 433, and 435 (i.e., first microstrip line 431, second microstrip line 433, and third microstrip line 435), two shorting plates 451 and 453 (i.e., first shorting plate 451 and second shorting plate 453), and two feed terminals 471 and 473 (i.e., first feed terminal 471 and second feed terminal 473).

The first microstrip line 431, the second microstrip line 433, the first feed terminal 471, the second feed terminal 473, and the RFID tag chip 10 are formed on an upper plane of the first dielectric material substrate 411, and the first shorting plate 451 and the second shorting plate 453 are formed in two side planes of four side planes of the first dielectric material substrate 411.

In addition, the third microstrip line 435 is formed on an upper plane of the second dielectric material substrate 413, and a bottom plane of the second dielectric material substrate 413 partially contacts the upper plane of the first dielectric material substrate 411 such that the tag antenna 400 has a stacked structure of the first dielectric material substrate 411 and the second dielectric material substrate 413.

The first dielectric material substrate 411 has a cuboid shape, and a bottom plane thereof corresponds to a ground plane.

The first microstrip line 431 has a predetermined polygon shape like "⊢," and is partially formed in the upper plane of the first dielectric material substrate 411 (i.e., an upper left area of the first dielectric material substrate 411 in the drawing) so as to contact the left side of the first dielectric material substrate 411. In this instance, one end of the first microstrip line 431 is disconnected by the first shorting plate 451 formed in the left side of the first dielectric material substrate 411, and the other end is opened.

The second microstrip line 433 has a predetermined polygon shape like "⊣," and is partially formed in the upper plane of the first dielectric material substrate 411 (i.e., the upper right area of the first dielectric material substrate 411 in the drawing) so as to contact the right side of the first dielectric material substrate 411. In this instance, one end of the second microstrip line 433 is disconnected by the second shorting plate 453 formed in the right side of the first dielectric material substrate 411, and the other end is opened.

The opened end of the first microstrip line 431 and the opened end of the second microstrip line 433 face each other at a center portion of the first dielectric material substrate 411.

The first shorting plate 451 having a rectangle shape is formed in one side of the four sides the first dielectric material substrate 411 (i.e., the left side of the first dielectric material substrate 411 in the drawing), and connects the ground plane that corresponds to the bottom plane of the first dielectric material substrate 411 and first microstrip line 431 so as to disconnect the first microstrip line 431 from the ground plane.

The second shorting plate 453 having a rectangle shape is formed in one side the four sides of the first dielectric material substrate 411 (i.e., the right side of the first dielectric material substrate 411 in the drawing), and disconnects the ground plane that corresponds to the bottom plane of the first dielectric material substrate 411 and the second microstrip line 433 so as to disconnect the second microstrip line 433 from the ground plane.

The first feed terminal 471 is formed in a part of the upper plane of the first dielectric material substrate 411 and contacts the opened end of the first microstrip line 431 such that the first feed terminal 471 is electrically connected to the first microstrip line 431.

The second feed terminal 473 is formed in a part of the upper plane of the first dielectric material substrate 411 and contacts the opened end of the second microstrip line 433 such that the second feed terminal 473 is electrically connected to the second microstrip line 433.

The first feed terminal 471 and the second feed terminal 473 are formed between the opened end of the first microstrip line 431 and the opened end of the second microstrip line 433 facing each other, and the RFID tag chip 10 is formed between the first feed terminal 471 and the second feed terminal 473.

The second dielectric material substrate 413 has a cuboid shape, and a bottom plane thereof contacts a part of the upper plane of the first dielectric material substrate 411, a part of the first microstrip line 431, a part of the second microstrip line 433, the first feed terminal 471, the second feed terminal 473, and the RFID tag chip 10.

The third microstrip line 435 has a predetermined shape, that is, a shape having a curved outer edge formed in a part of the upper plane of the second dielectric material substrate 413, and lateral ends of the third microstrip line 435 are opened. In this instance, the third microstrip line 435 does not include a ground plane, and the first microstrip line 431 and the second microstrip line 433 serve as the ground plane of the third microstrip line 435 instead.

An RFID tag according to another exemplary embodiment of the present invention will be described with reference to FIG. 6.

Figure 6:
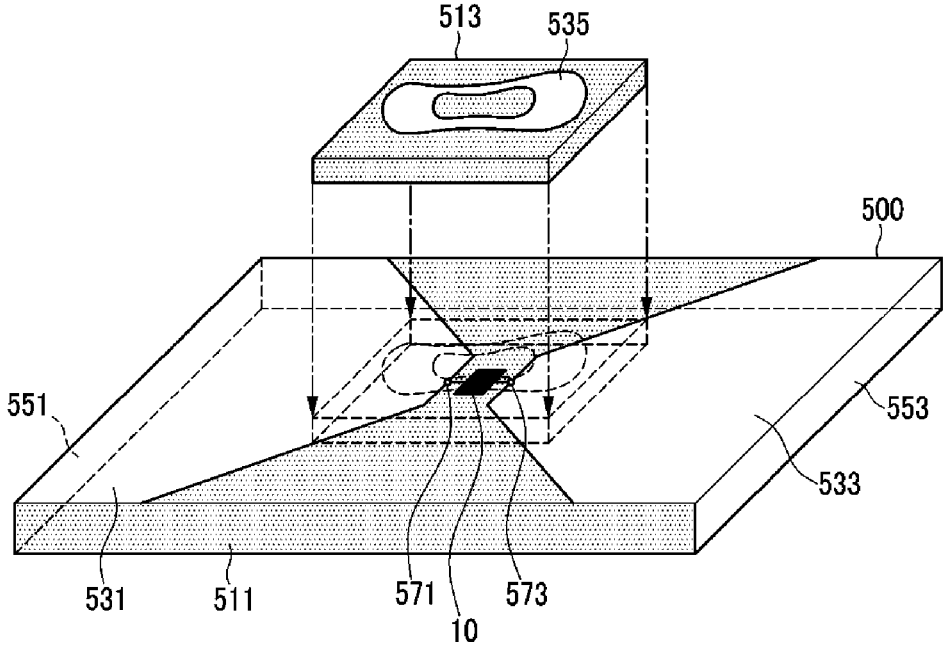
FIG. 6 is a configuration of an RFID tag according to another exemplary embodiment of the present invention.

FIG. 6 shows an RFID tag according to another exemplary embodiment of the present invention.

As shown in FIG. 6, the RFID tag according to the exemplary embodiment of the present invention includes an RFID tag chip 10 and a tag antenna 500.

The tag antenna 500 includes two dielectric material substrates 511 and 513 (i.e., first dielectric material substrate 511 and second dielectric material substrate 513), three microstrip lines 531, 533, and 535 (i.e., first microstrip line 531, second microstrip line 533, and third microstrip line 535), two shorting plates 551 and 553 (i.e., first shorting plate 551 and second shorting plate 553), and two feed terminals 571 and 573 (i.e., first feed terminal 571 and second feed terminal 573).

The first microstrip line 531, the second microstrip line 533, the first feed terminal 571, the second feed terminal 573, and the RFID tag chip 10 are formed on an upper plane of the first dielectric material substrate 511, and the first shorting plate 551 and the second shorting plate 553 are formed in two sides among four sides of the first dielectric material substrate 511.

In addition, the third microstrip line 535 is formed on an upper plane of the second dielectric material substrate 513, and a bottom plane of the second dielectric material substrate 513 partially contacts the upper plane of the first dielectric material substrate 511 such that the tag antenna 500 has a stacked structure of the first dielectric material substrate 511 and the second dielectric material substrate 513.

The first dielectric material substrate 511 has a cuboid shape, and a bottom plane thereof corresponds to a ground plane.

The first microstrip line 531 has a specific polygon shape (i.e., a hexagon shape), and is formed in a part of the upper plane of the first dielectric material substrate 511 (i.e., the upper left area of the first dielectric material substrate 511 in the drawing) so as to contact the left side of the first dielectric material substrate 511. In this instance, one end of the first microstrip line 531 is disconnected by the first shorting plate 551 formed in the left side of the first dielectric material substrate 511, and the other end is opened.

The second microstrip line 533 has a specific polygon shape (i.e., a hexagon shape) and is formed in a part of the upper plane of the first dielectric material substrate 511 (i.e., the upper right area of the first dielectric material substrate 511 in the drawing) such that the second microstrip line 533 contacts the right side of the first dielectric material substrate 511. In this instance, one end of the second microstrip line 533 is disconnected by the second shorting plate 553 formed in the right side of the first dielectric material substrate 511, and the other end is opened.

The opened end of the first microstrip line 531 and the opened end of the second microstrip line 533 face each other at a center area of the first dielectric material substrate 511.

The first shorting plate 551 has a rectangle shape and is formed in one side of four sides of the first dielectric material substrate 511 (i.e., the left side of the first dielectric material substrate 511 in the drawing), and connects the ground plane that corresponds to the bottom plane of the first dielectric material substrate 511 and the first microstrip line 531 so as to disconnect the first microstrip line 531 from the ground plane.

The second shorting plate 553 has a rectangle shape and is formed in one side of the four sides of the first dielectric material substrate 511 (i.e., the right side of the first dielectric material substrate 511 in the drawing), and connects the ground plane that corresponds to the bottom plane of the first dielectric material substrate 511 and the second microstrip line 533 so as to disconnect the second microstrip line 533 from the ground plane.

The first feed terminal 571 is partially formed in the upper plane of the first dielectric material substrate 511 and contacts the opened end of the first microstrip line 531 such that the first feed terminal 571 is electrically connected to the first microstrip line 531.

The second feed terminal 573 is partially formed in the upper plane of the first dielectric material substrate 511 and contacts the opened end of the second microstrip line 533 such that the second feed terminal 573 is electrically connected to the second microstrip line 533.

The first feed terminal 571 and the second feed terminal 573 are formed between the opened end of the first microstrip line 531 and the opened end of the second microstrip line 533 facing each other, and the RFID tag chip 10 is formed between the first feed terminal 571 and the second feed terminal 573.

The second dielectric material substrate 513 has a cuboid shape, and a bottom plane thereof contacts a part of the upper plane of the first dielectric material substrate 511, a part of the first microstrip line 531, a part of the second microstrip line 533, the first feed terminal 571, the second feed terminal 573, and the RFID tag chip 10.

The third microstrip line 535 has a specific shape, that is, a ring shape with a curved outer edge, and is formed in a part of the upper plane of the second dielectric material substrate 513 and lateral ends of the third microstrip line 535 are opened. In this instance, the third microstrip line 535 does not include a ground plane, and the first microstrip line 531 and the second microstrip line 533 serve as the ground plane of the third microstrip line 535 instead.

An RFID tag according to another exemplary embodiment of the present invention will be described with reference to FIG. 7.

Figure 7:
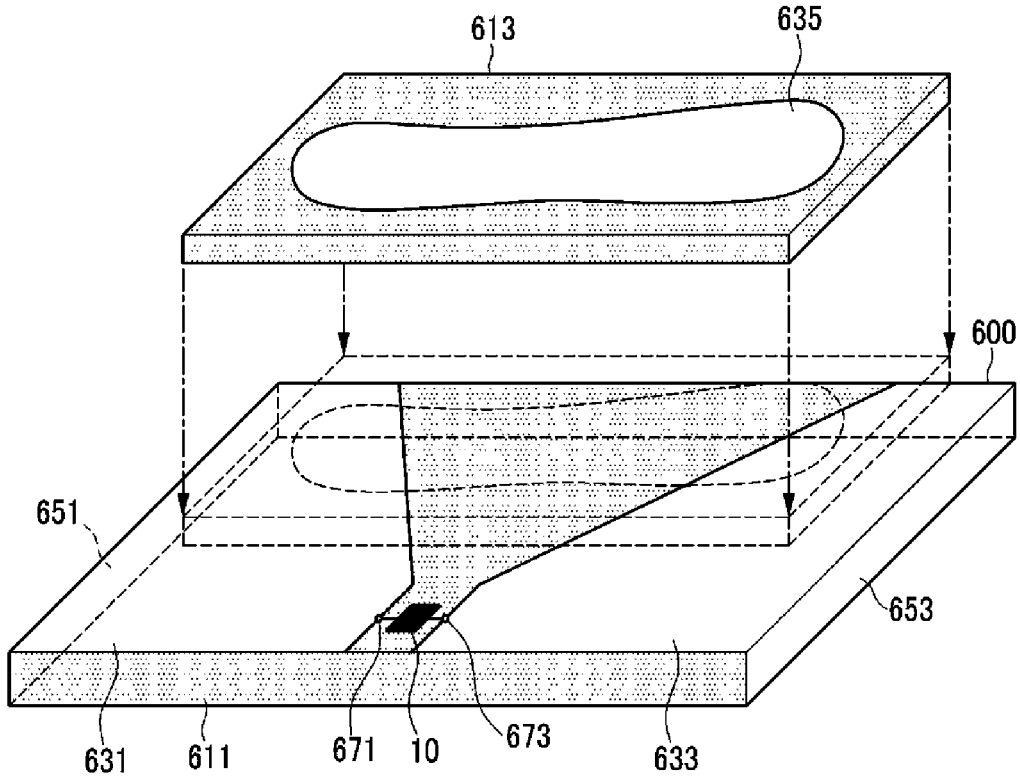
FIG. 7 is a configuration of an RFID tag according to another exemplary embodiment of the present invention.

FIG. 7 shows an RFID tag according to another exemplary embodiment of the present invention.

As shown in FIG. 7, the RFID tag according to the exemplary embodiment of the present invention includes an RFID tag chip 10 and a tag antenna 600.

The tag antenna 600 includes two dielectric material substrates 611 and 613 (i.e., first dielectric material substrate 611 and second dielectric material substrate 613), three microstrip lines 631, 633, and 635 (i.e., first microstrip line 631, second microstrip line 633, and third microstrip line 635), two shorting plates 651 and 653 (i.e., first shorting plate 651 and second shorting plate 653), and two feed terminals 671 and 673 (i.e., first feed terminal 671 and second 673).

The first microstrip line 631, the second microstrip line 633, the first feed terminal 671, the second feed terminal 673, and the RFID tag chip 10 are formed on an upper plane of the first dielectric material substrate 611, and the first shorting plate 651 and the second shorting plate 653 are formed in two sides among four sides of the first dielectric material substrate 611.

In addition, the third microstrip line 635 is formed on an upper plane of the second dielectric material substrate 613, and a bottom plane of the second dielectric material substrate 613 partially contacts the upper plane of the first dielectric material substrate 611 such that the tag antenna 600 has a stacked structure of the first dielectric material substrate 611 and the second dielectric material substrate 613.

The first dielectric material substrate 611 has a cuboid shape, and a bottom plane thereof corresponds to a ground plane.

The first microstrip line 631 has a specific polygon shape, that is, a pentagon shape, and is formed in a part of the upper plane of the first dielectric material substrate 611 (i.e., the upper left area of the first dielectric material substrate 611 in the drawing) so as to contact the left side of the first dielectric material substrate 611. In this instance, one end of the first microstrip line 631 is disconnected by the first shorting plate 651 formed in the left side of the first dielectric material substrate 611, and the other end is opened.

The second microstrip line 633 has a specific polygon shape, that is, a pentagon shape, and is formed in a part of the upper plane of the first dielectric material substrate 611 (i.e., the upper right side of the first dielectric material substrate 611 in the drawing) so as to contact the right side of the first dielectric material substrate 611. In this instance, one end of the second microstrip line 633 is disconnected by the second shorting plate 653 formed in the right side of the first dielectric material substrate 611, and the other end is opened.

The opened end of the first microstrip line 631 and the opened end of the second microstrip line 633 face each other at a center area of the first dielectric material substrate 611.

The first shorting plate 651 has a rectangle shape, and is formed in one of four sides of the first dielectric material substrate 611 (i.e., the left side of the first dielectric material substrate 611 in the drawing) and connects the ground plane that corresponds to the bottom plane of the first dielectric material substrate 611 and the first microstrip line 631 so as to disconnect the first microstrip line 631 from the ground plane.

The second shorting plate 653 has a rectangle shape and is formed in one of four sides of the first dielectric material substrate 611 (i.e., the right side of the first dielectric material substrate 611 in the drawing), and connects the ground plane that corresponds to the bottom plane of the first dielectric material substrate 611 and the second microstrip line 633 so as to disconnect the second microstrip line 633 from the ground plane.

The first feed terminal 671 is formed in a part of the upper plane of the first dielectric material substrate 611, and contacts the opened end of the first microstrip line 631 such that the first feed terminal 671 is electrically connected to the first microstrip line 631.

The second feed terminal 673 is formed in a part of the upper plane of the first dielectric material substrate 611, and contacts the opened end of the second microstrip line 633 such that the second feed terminal 673 is electrically connected to the second microstrip line 633.

In this instance, the first feed terminal 671 and the second feed terminal 673 are formed between the opened end of the first microstrip line 631 and the opened end of the second microstrip line 633 facing each other, and the RFID tag chip 10 is formed between the first feed terminal 671 and the second feed terminal 673.

The second dielectric material substrate 613 has a cuboid shape, and the bottom plane thereof partially contacts the upper plane of the first dielectric material substrate 611, the first microstrip line 631, and the second microstrip line 633.

The third microstrip line 635 has a specific shape, that is, a shape with a curved outer edge, and is formed in a part of the upper plane of the second dielectric material substrate 613, and lateral ends of the third microstrip line 635 are opened. In this instance, the third microstrip line 635 does not include a ground plane, and the first microstrip line 631 and the second microstrip line 633 serve as the ground plane of the third microstrip line 635 instead.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A radio frequency identification (RFID) tag including an antenna that receives an interrogation signal corresponding to a radio frequency (RF) signal and a chip that generates a response signal corresponding to the interrogation signal, the RFID tag comprising:

the antenna, comprising:

a first polygonal dielectric material having a first plane surface corresponding to a ground plane and a second plane surface that does not contact the first plane surface;

a first microstrip line formed in a part of the second plane surface, and having first and second lateral ends and covering a left side of the second plane surface at least at corner surfaces of the left side;

a second microstrip line formed in another part of the second plane surface, and having first and second lateral ends and covering a right side of the second plane surface opposite the left side at least at corner surfaces of the right side, wherein the first lateral ends of the first and second microstrip lines face each other;

a second polygonal dielectric material having a third plane surface and a fourth plane surface that does not contact the third plane surface, and that is stacked on the second plane surface of the first dielectric material such that the third plane surface is stacked on and contacts the second plane surface; and a third microstrip line formed in the fourth plane surface, and having two lateral ends, wherein the second lateral ends of the first and second microstrip lines are electrically connected to the ground plane, wherein the first microstrip line and the second microstrip line serve as a ground plane of the third microstrip line; and the chip partially formed in the second plane surface and electrically connected to the first lateral ends of the first and second microstrip lines, wherein the chip transmits the response signal corresponding to the interrogation signal through the antenna.

2. The RFID tag of claim 1, wherein the antenna further comprises:

a first feed terminal connected to one of the first and second lateral ends of the first microstrip line;

and a second feed terminal connected to one of the first and second lateral ends of the second microstrip line, and the chip is partially formed in the second plane to contact the third plane, is electrically connected to the first microstrip line through the first feed terminal, and is electrically connected to the second microstrip line through the second feed terminal.

3. The RFID tag of claim 2, wherein impedance of the antenna and impedance of the chip respectively comprise a resistance component and a reactance component, a value of the resistance component of the impedance of the antenna and a value of the resistance component of the impedance of the chip are the same in size and have the same sign, and the value of the reactance component of the impedance of the antenna and the value of the reactance component of the impedance of the chip are the same in size but opposite in sign.

4. The RFID tag of claim 3, wherein the impedance of the antenna corresponds to the length of the first microstrip line, the length of the second microstrip line, and the length of the third microstrip line.

5. The RFID tag of claim 4, wherein the resistance component of the impedance of the antenna corresponds to the width of an end connected to the first feed terminal among the first and second lateral ends of the first microstrip line and the width of an end connected to the second feed terminal among the first and second lateral ends of the second microstrip line, and the reactance component of the impedance of the antenna corresponds to the distance of the first and second lateral ends of the first microstrip line, the distance of the first and second lateral ends of the second microstrip line, and the distance of the two lateral ends of the third microstrip line.

6. A radio frequency identification (RFID) antenna for receiving and transmitting radio frequency (RF) signals, the RFID antenna comprising:

a first polygonal dielectric material having a first plane surface corresponding to a ground plane and a second plane surface that does not contact the first plane surface;

a first microstrip line formed in a part of the second plane surface, and having first and second lateral ends and covering a left side of the second plane surface at least at corner surfaces of the left side;

a second microstrip line formed in a part of the second plane surface, and having first and second lateral ends and covering a right side of the second plane surface opposite the left side at least at corner surfaces of the right side;

a second polygonal dielectric material having a third plane surface and a fourth plane surface, and stacked on the second plane surface of the first dielectric material such that the third plane surface is stacked on and partially contacts the second plane surface, the first microstrip line, and the second microstrip line; and a third microstrip line partially or entirely formed in the fourth plane surface, wherein the first lateral ends of the first microstrip line and of the second microstrip line face each other, wherein the first microstrip line and the second microstrip line serve as a ground plane surface of the third microstrip line, and wherein the RFID antenna has an impedance that is adjustable based on dielectric loss rates of the first and second polygonal dielectric materials, lengths, widths, and impedances of the first, second, and third microstrip line.

7. The RFID antenna of claim 6, wherein one of the first and second microstrip lines has first and second lateral ends that are the same in width.

8. The RFID antenna of claim 6, wherein one of the first and second microstrip lines has first and second lateral ends that are different from each other in width.

9. The RFID antenna of claim 8, wherein the first microstrip line and the second microstrip line respectively have lateral ends that are different from each other in width, and a shorter one of the first and second lateral ends of the first microstrip line and a shorter one of the first and second lateral ends of the second microstrip line face each other.

10. The RFID antenna of claim 6, wherein the third microstrip line has a curved circumference.

11. The RFID antenna of claim 10, wherein the microstrip line has a ring shape.

12. The RFID antenna of claim 6, wherein the third microstrip line has a polygonal-shaped circumference.

13. The RFID antenna of claim 6, further comprising:

a first shorting plate formed in a fifth plane that connects the first and second planes, and physically connecting the first microstrip line and the ground plane so as to short the first microstrip line from the ground plane; and a second shorting plate formed in a sixth plane that connects the first and second planes, and physically connecting the second microstrip line and the ground plane so as to short the second microstrip line from the ground plane.

* * * * *